US008302786B2

(12) United States Patent
Kao

(10) Patent No.: US 8,302,786 B2
(45) Date of Patent: Nov. 6, 2012

(54) TOOL HANGER ASSEMBLY

(76) Inventor: Jui-Chien Kao, Tali (TW)

( * ) Notice: Subject to any disclaimer, the term of this patent is extended or adjusted under 35 U.S.C. 154(b) by 149 days.

(21) Appl. No.: 12/973,874

(22) Filed: Dec. 20, 2010

(65) Prior Publication Data

US 2012/0152871 A1 Jun. 21, 2012

(51) Int. Cl.
*A47F 7/00* (2006.01)

(52) U.S. Cl. ..... 211/70.6

(58) Field of Classification Search ..... 211/70.6, 211/94.01, 69, 66, 70.8, 89.01, DIG. 1, 87.01, 211/175; 206/349, 372, 373, 375, 376, 378, 206/493; 248/111, 113, 223.41, 231.85, 248/316.4

See application file for complete search history.

(56) References Cited

U.S. PATENT DOCUMENTS 2,754,974 A * 7/1956 Larson ..... 211/70.6
3,980,384 A * 9/1976 Lawson ..... 439/710
4,828,002 A * 5/1989 Ashby ..... 160/38
5,109,992 A * 5/1992 Miller ..... 211/59.1
5,544,747 A * 8/1996 Horn ..... 206/378
6,070,745 A * 6/2000 Dembicks ..... 211/70.6
6,431,373 B1 * 8/2002 Blick ..... 211/70.6
6,488,151 B2 * 12/2002 Ramsey et al. ..... 206/378
7,694,832 B2 * 4/2010 Kao ..... 211/70.6
7,717,278 B2 * 5/2010 Kao ..... 211/70.6
7,861,871 B2 * 1/2011 Kao ..... 211/70.6
7,950,534 B2 * 5/2011 Kao ..... 211/70.6
8,152,003 B1 * 4/2012 Kao ..... 211/70.6
2006/0207951 A1 * 9/2006 Wang ..... 211/70.6
2007/0017886 A1 * 1/2007 Kao ..... 211/94.01
2008/0023420 A1 * 1/2008 Kao ..... 211/70.6
2008/0041800 A1 * 2/2008 Kao ..... 211/70.6
2009/0090644 A1 * 4/2009 Kao ..... 206/373

* cited by examiner

*Primary Examiner* — Jennifer E. Novosad
(74) *Attorney, Agent, or Firm* — Hershkovitz & Associates LLC

(57) ABSTRACT

A tool hanger assembly has a frame and a hanger. The frame has a back plate and a bracket. The bracket is mounted securely on the back plate and has a recess formed in the bracket. The hanger is connected securely with the frame and has a base plate and multiple tool mounts. The base plate is mounted securely in the recess. The tool mounts are securely mounted on the base plate to allow screwdrivers to be hung on. Accordingly, to assemble the hanger having the multiple tool mounts with the frame is quick, reduces manufacturing cost and is convenient.

6 Claims, 11 Drawing Sheets

TOOL HANGER ASSEMBLY

BACKGROUND OF THE INVENTION

1. Field of the Invention

The present invention relates to a tool hanger assembly, and more particularly to a tool hanger assembly to save time for assembling.

2. Description of Related Art

A conventional tool hanger assembly has a frame and multiple hangers. The frame has a track formed in a side surface of the frame. The hangers are slidably mounted on the track and each hanger has a tool mount protruding from the hanger to hang a hand tool, such as a screwdriver.

However, the hangers have to be attached to the frame one by one, so to assemble the multiple hangers onto the frame is time-consuming, increases manufacturing cost and is not convenient.

To overcome the shortcomings, the present invention intends to provide a tool hanger assembly to obviate the aforementioned problems.

SUMMARY OF THE INVENTION

The main objective of the invention is to provide a tool hanger assembly to save time for assembling.

A tool hanger assembly has a frame and a hanger. The frame has a back plate and a bracket. The bracket is mounted securely on the back plate and has a recess formed in the bracket. The hanger is connected securely with the frame and has a base plate and multiple tool mounts. The base plate is mounted securely in the recess. The tool mounts are securely mounted on the base plate to allow screwdrivers to be hung on. Accordingly, to assemble the hanger having the multiple tool mounts with the frame is quick, reduces manufacturing cost and is convenient.

Other objectives, advantages and novel features of the invention will become more apparent from the following detailed description when taken in conjunction with the accompanying drawings.

DETAILED DESCRIPTION OF PREFERRED EMBODIMENT

Figure 1:
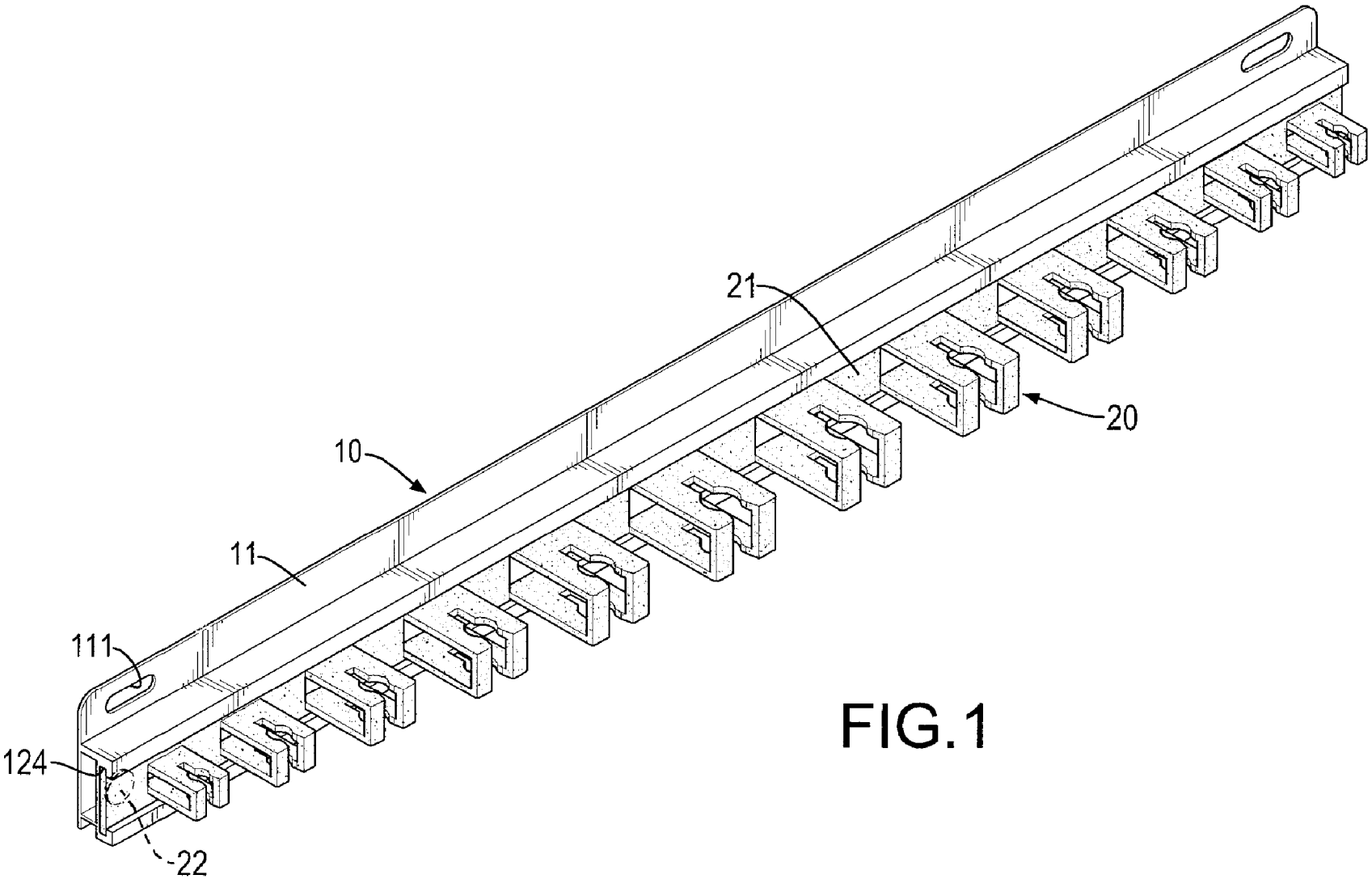
FIG. 1 is a perspective view of a first embodiment of a tool hanger assembly in accordance with the present invention.
Figure 2:
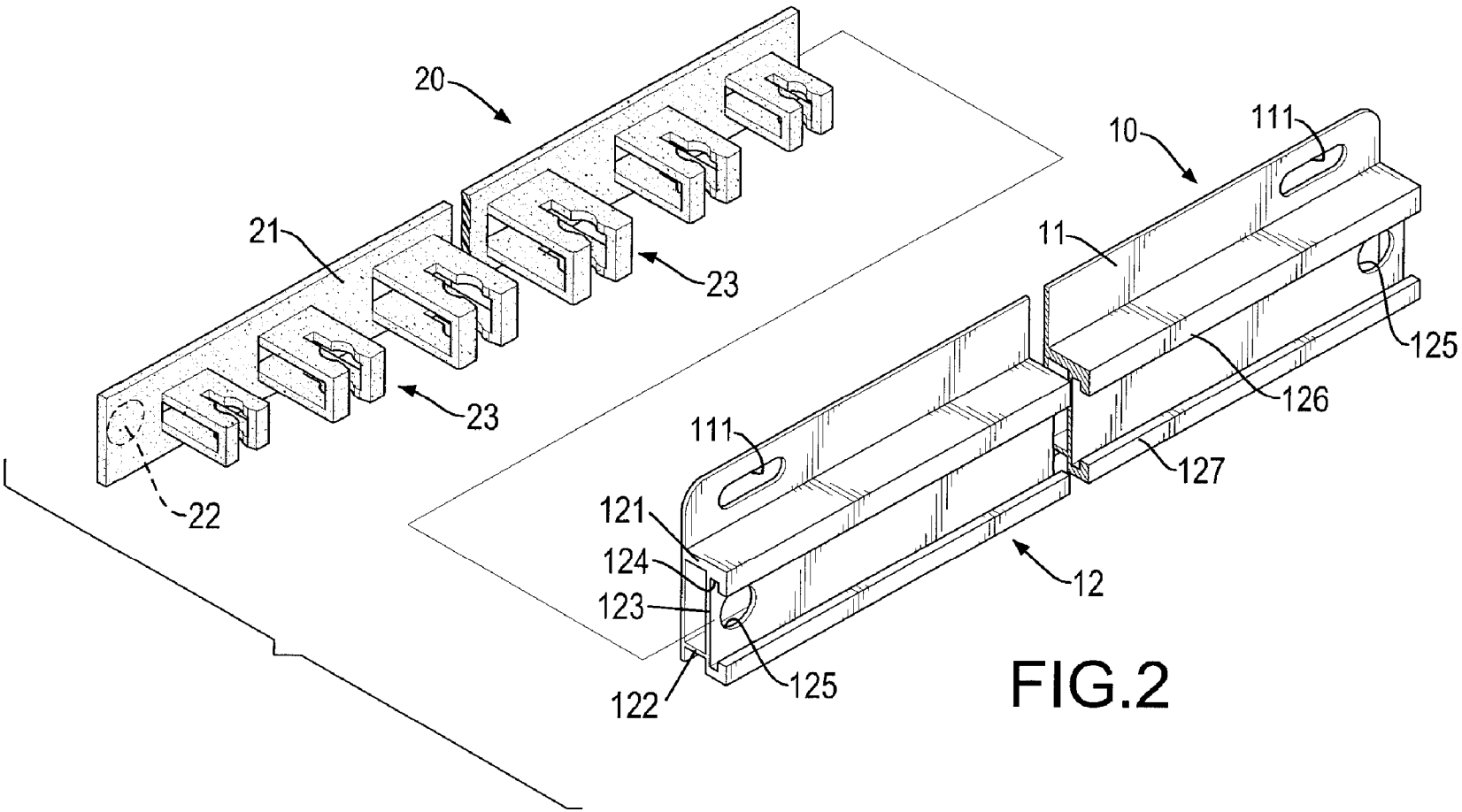
FIG. 2 is an enlarged exploded perspective view of the tool hanger assembly in FIG. 1.
Figure 3:
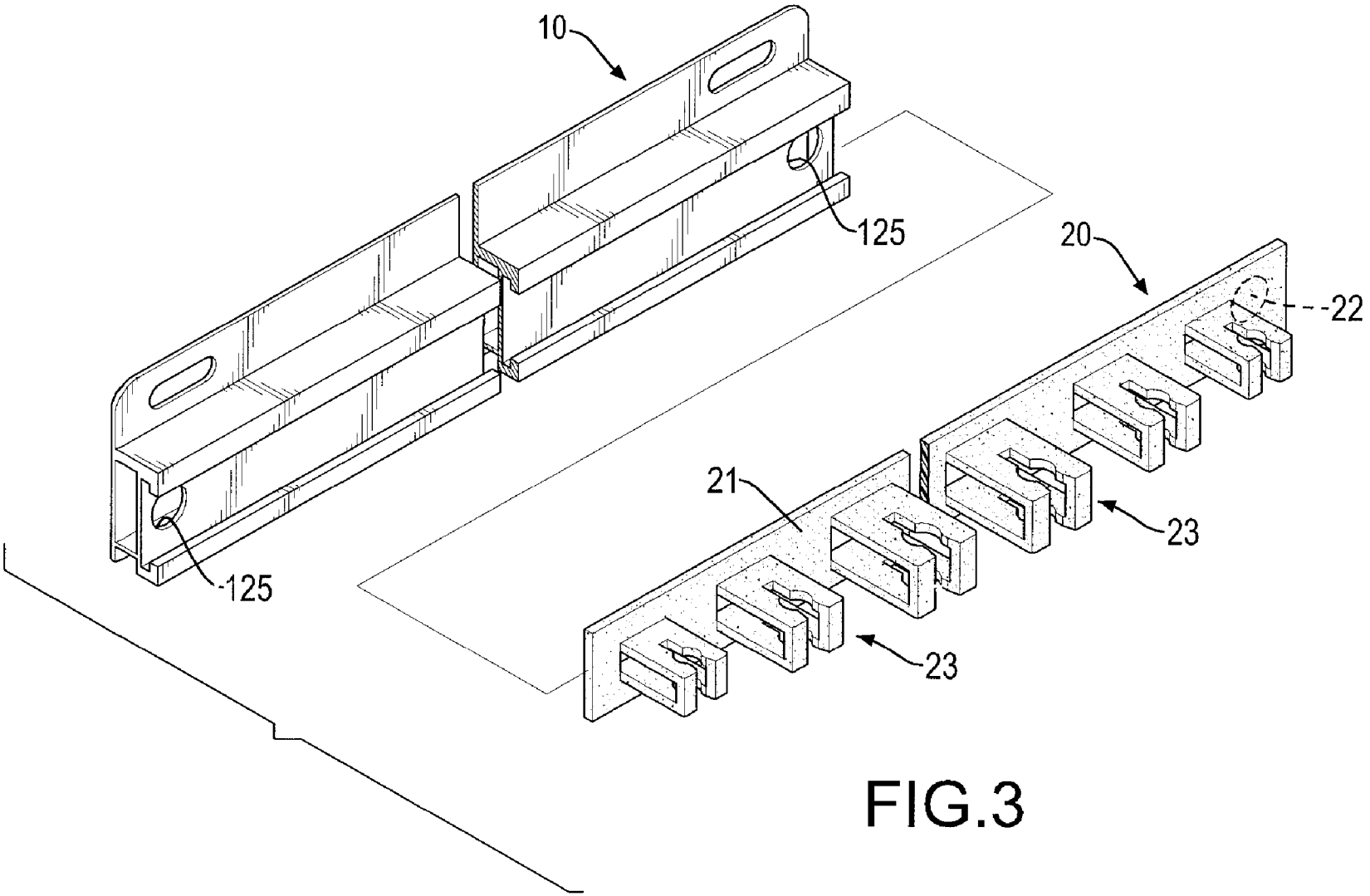
FIG. 3 is another enlarged exploded perspective view of the tool hanger assembly in FIG. 1.
Figure 4A:
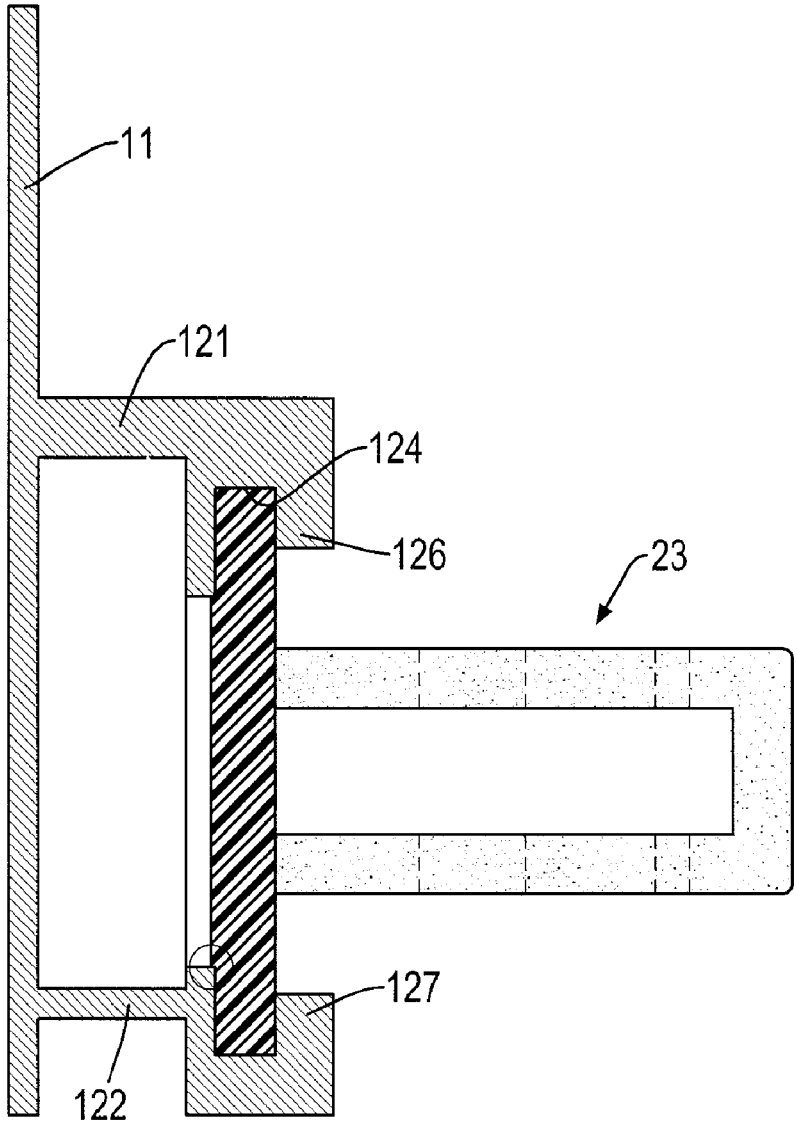
FIG. 4A is an enlarged side view in partial section of the tool hanger assembly in FIG. 1.
Figure 4B:
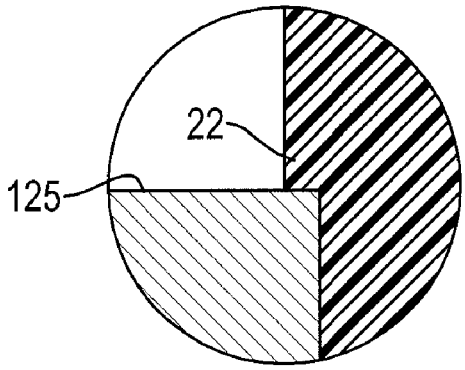
FIG. 4B is an enlarged side view in partial section of the tool hanger assembly in FIG. 4A.
Figure 5:
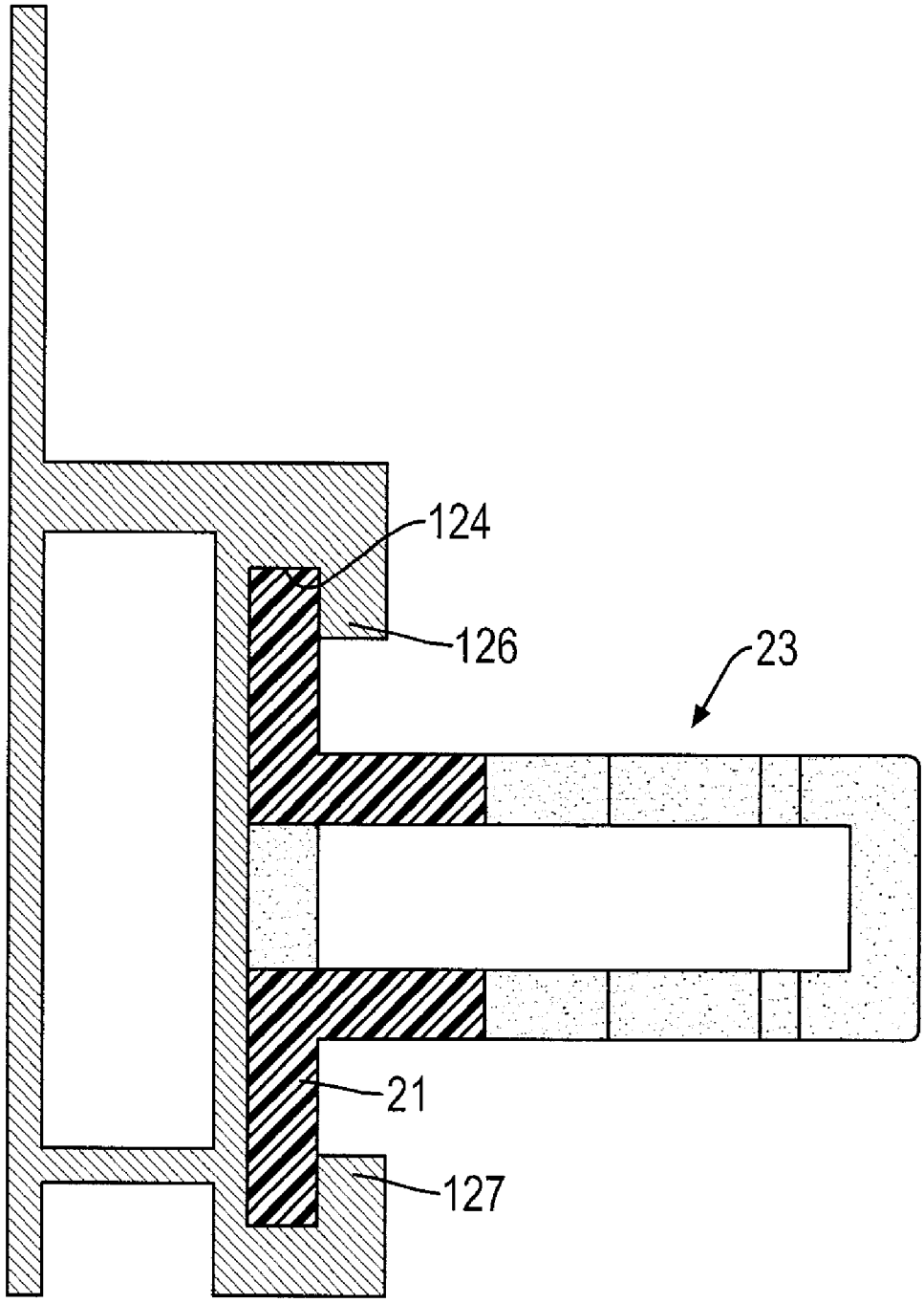
FIG. 5 is another enlarged side view in partial section of the tool hanger assembly in FIG. 1.

With reference to FIGS. 1 to 5, a first embodiment of a tool hanger assembly in accordance with the present invention comprises a frame 10 and a hanger 20.

The frame 10 is made of aluminum and has a back plate 11 and a bracket 12. The back plate 11 is elongated and has a top, a bottom, two opposite ends, a side surface and two mounting holes 111. The bottom is opposite to the top of the back plate 11. The mounting holes 111 are formed through near the top and respectively near the opposite ends of the back plate 11 to allow the frame 10 to be hung on a wall or a display board.

The bracket 12 is mounted securely on the side surface of the frame 10, is elongated and has a length, an upper protrusion 121, a lower protrusion 122, a front plate 123, a recess 124, two button holes 125, an upper rib 126 and a lower rib 127. The length of the bracket 12 is the same as that of the side surface of the back plate 11. The upper protrusion 121 is elongated, is mounted securely on the side surface near the top of the back plate 11 and is located below the mounting holes 111. The lower protrusion 122 is elongated, is mounted securely on the side surface near the bottom of the back plate 11 and is located below and parallel to the upper protrusion 121.

The front plate 123 is rectangular, is located between and securely mounted on the upper protrusion 121 and the lower protrusion 122 and has an abutting surface opposite to the back plate 11. The recess 124 is formed between the upper protrusion 121, the lower protrusion 122 and the front plate 123 and has a bottom located on the abutting surface of the front plate 123. The button holes 125 are round, are formed through the front plate 123 and are respectively adjacent to the ends of the back plate 11.

The upper rib 126 protrudes from the upper protrusion 121 toward the lower protrusion 122. The lower rib 127 protrudes from the lower protrusion 122 toward the upper rib 126.

With reference to FIGS. 1 to 5, the hanger 20 is connected securely with the frame 10 and has a base plate 21, a positioning button 22 and multiple tool mounts 23. The base plate 21 is made of plastic, is shaped as and mounted securely in the recess 124 and has a mounting surface. The mounting surface of the base plate 21 is opposite to the abutting surface of the front plate 123 and is abutted by the upper rib 126 and the lower rib 127.

The positioning button 22 is formed on the base plate 21 and is selectively engaged with one of the button holes 125. With reference to FIGS. 2 to 4B, the base plate 21 can be selectively slid into the recess 124 from one of two openings of the recess 124 to enable the positioning button 22 to be engaged with one of the button holes 125. Accordingly, assembling the base plate 21 in the recess 124 does not have to follow a specific direction and is very convenient and fast.

The tool mounts 23 are hollow, are mounted securely on the mounting surface of the base plate 21 at intervals and are located between the upper rib 126 and the lower rib 127.

Figure 7:
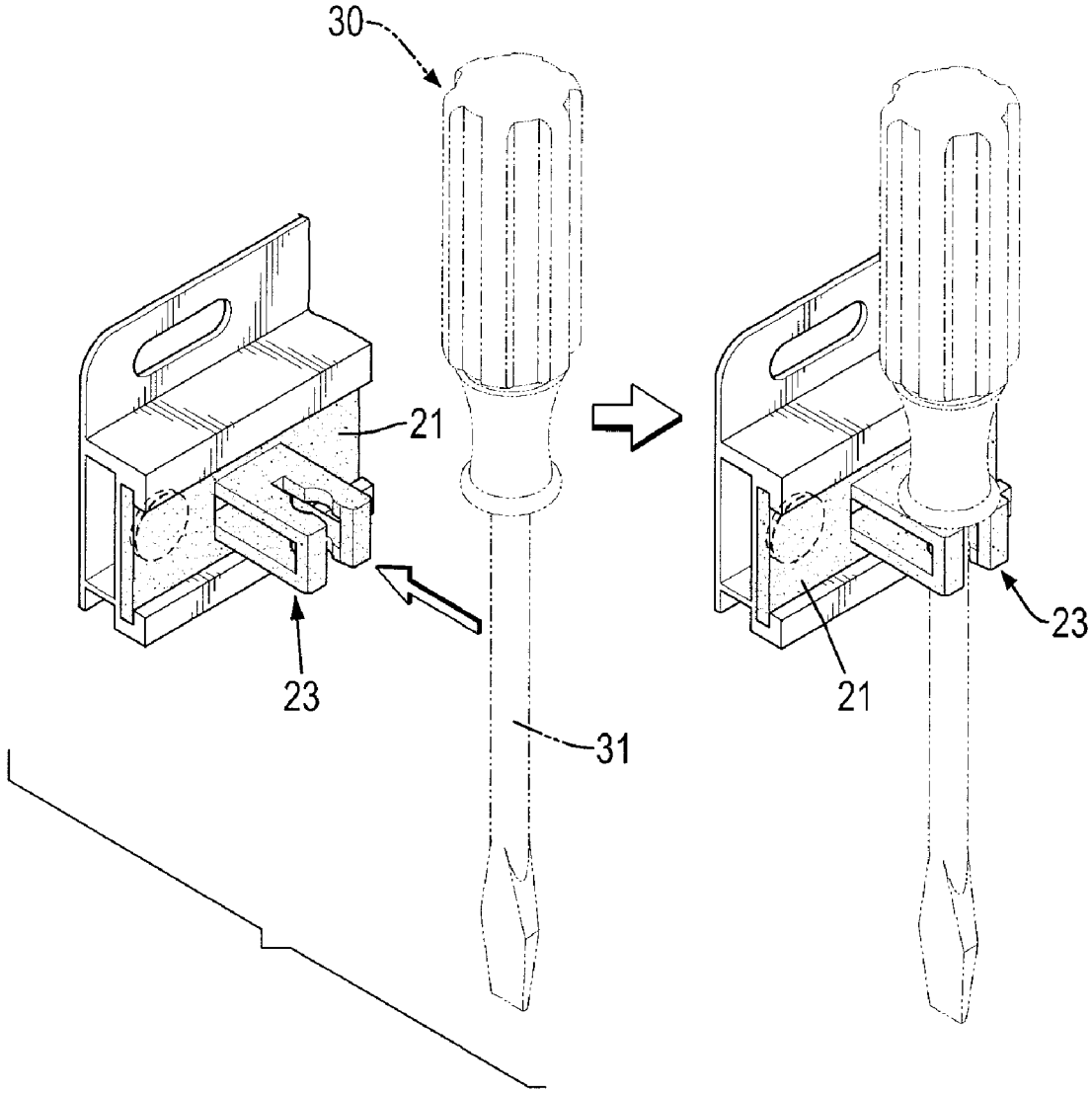
FIG. 7 is operational perspective views of the tool hanger assembly in FIG. 1.
Figure 8:
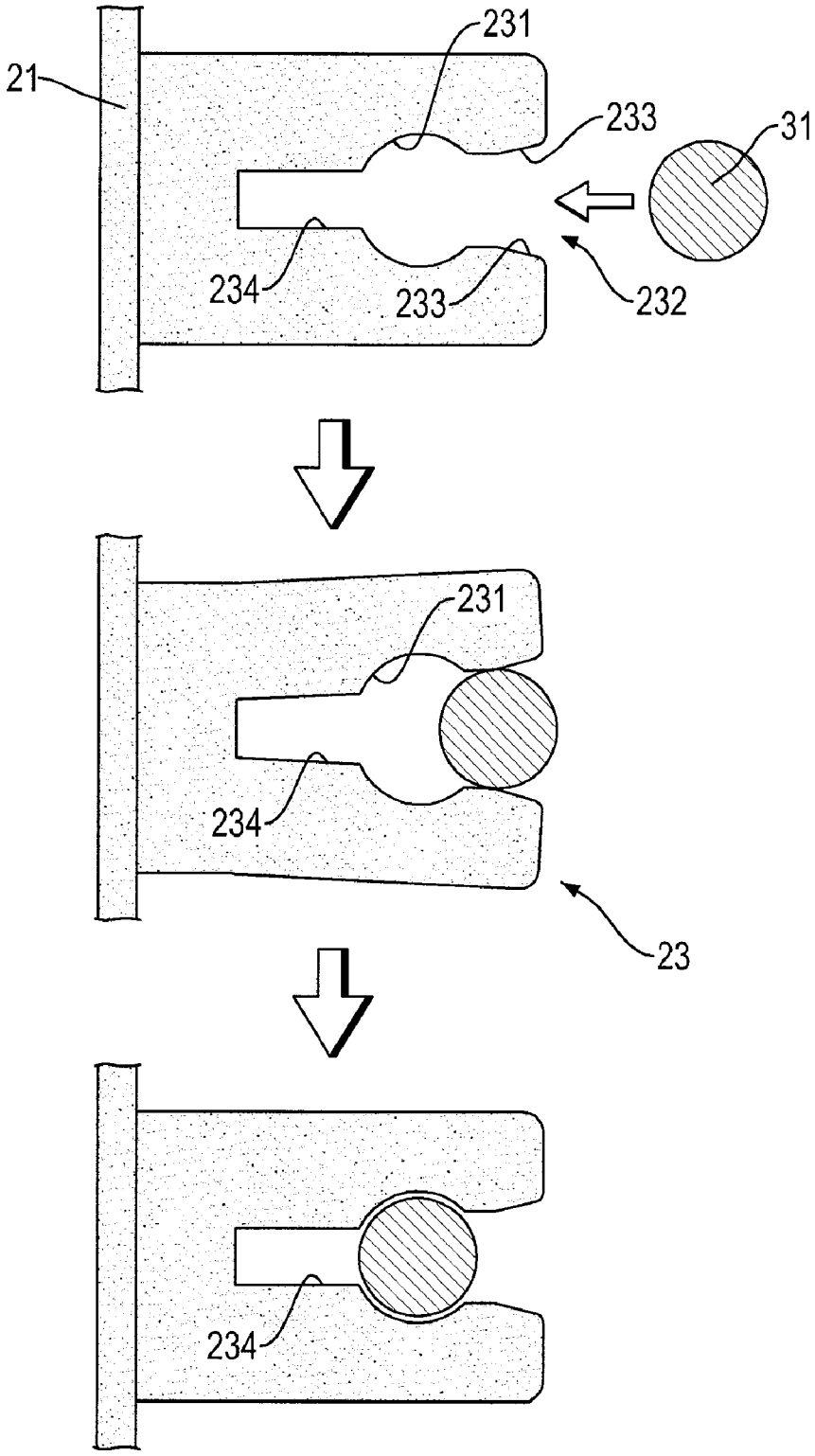
FIG. 8 is operational top views in partial section of the tool hanger assembly in FIG. 7.

With reference to FIGS. 7 to 8, each tool mount 23 has a top surface, a bottom surface, an operating surface, a tool hole 231, a mounting slit 232, two guiding faces 233 and a stretching groove 234. The operating surface is opposite to the base plate 21. The tool hole 231 is longitudinally formed through the top surface and the bottom surface of the tool mount 23. The mounting slit 232 is longitudinally formed in the operating surface, is formed through the top surface and the bottom surface of the tool mount 23, communicates with the tool hole 231 and has two opposite inner surfaces. The guiding faces 233 are respectively formed on the inner surfaces of the mounting slit 232. The stretching groove 234 is longitudinally formed in the tool mount 23 toward the base plate 21 and communicating with the tool hole 231.

Figure 6:
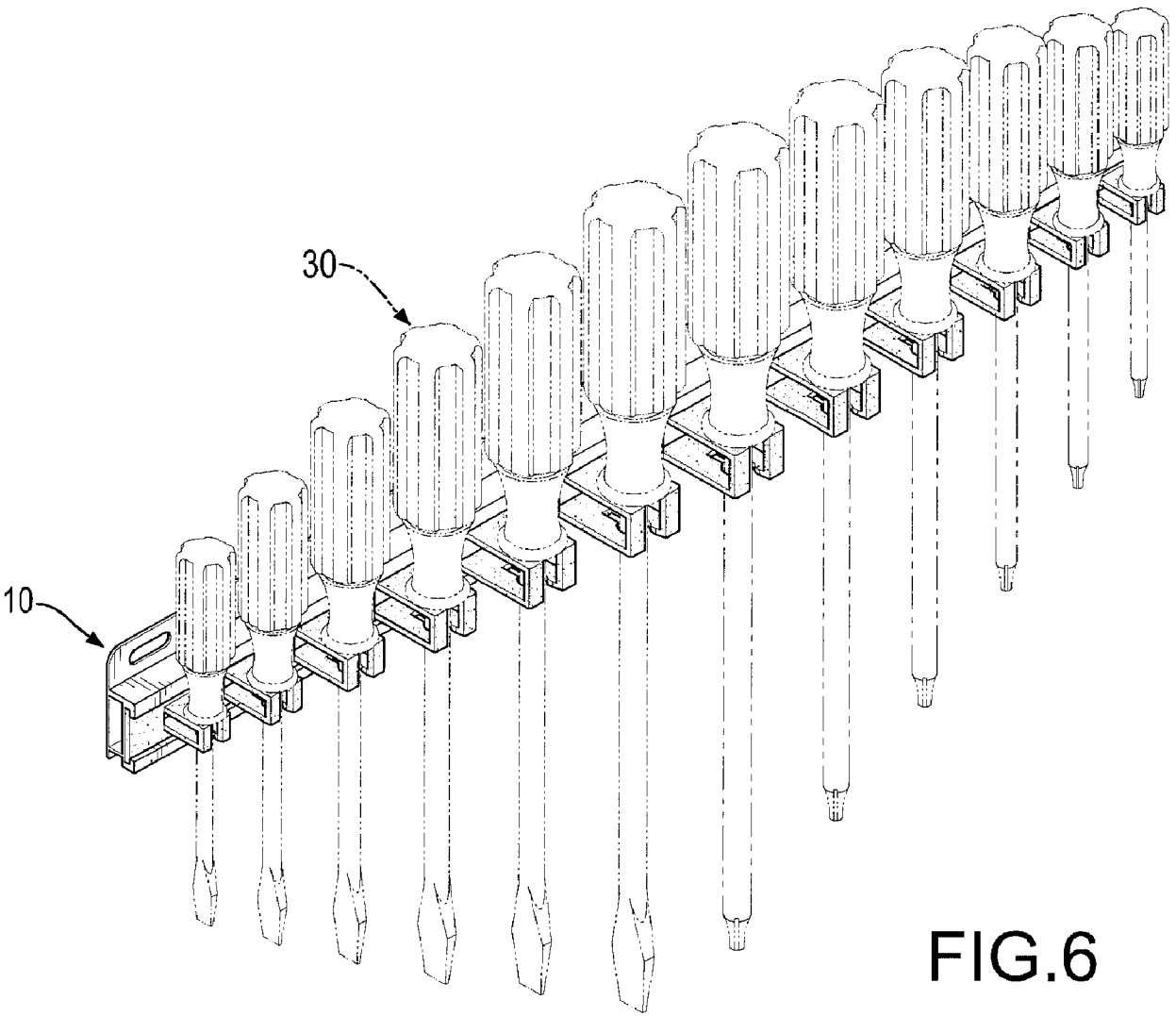
FIG. 6 is an operational perspective view of the tool hanger assembly in FIG. 1, wherein multiple screwdrivers are respectively hung on the tool mounts.
Figure 9:
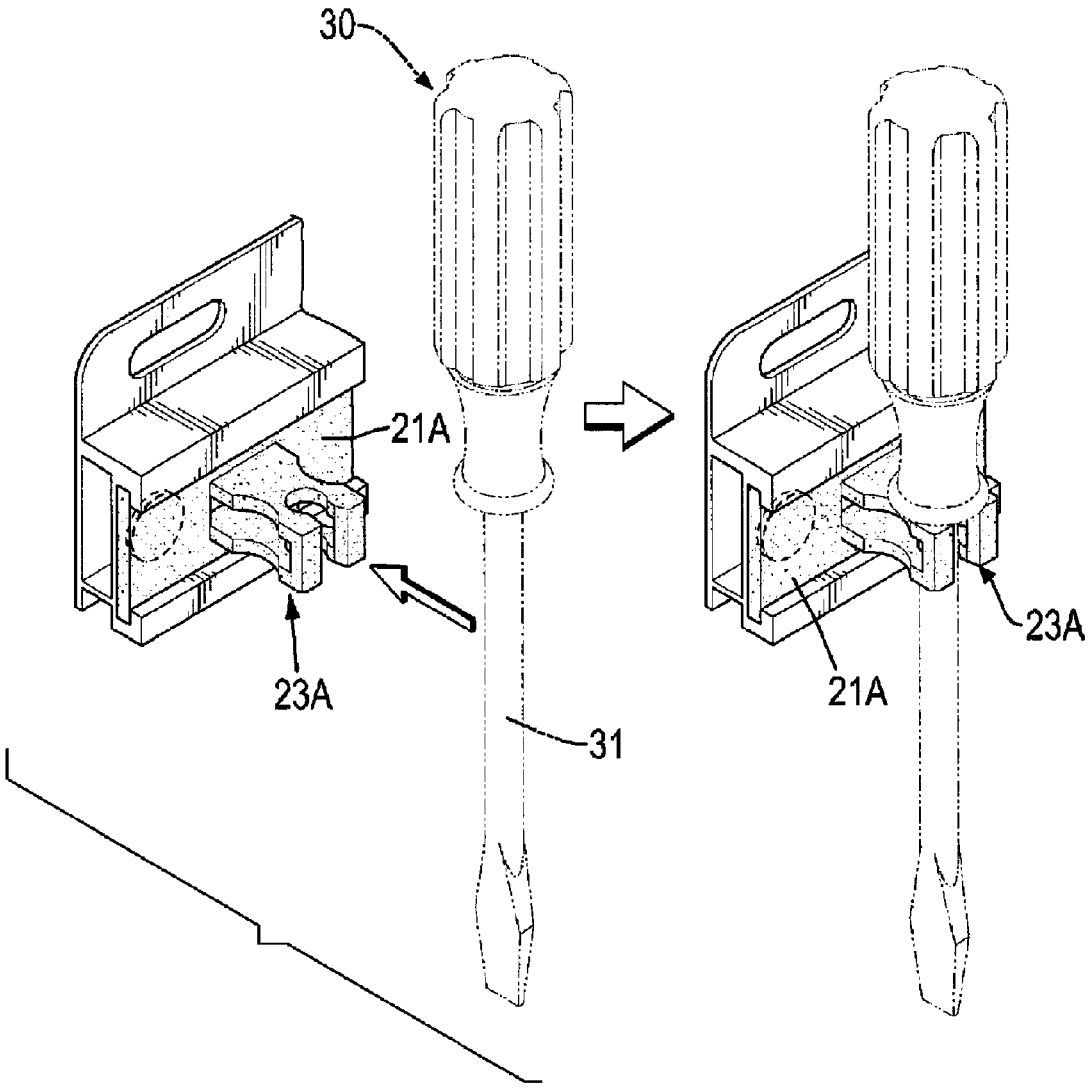
FIG. 9 is operational perspective views of a second embodiment of the tool hanger assembly in accordance with the present invention.
Figure 10:
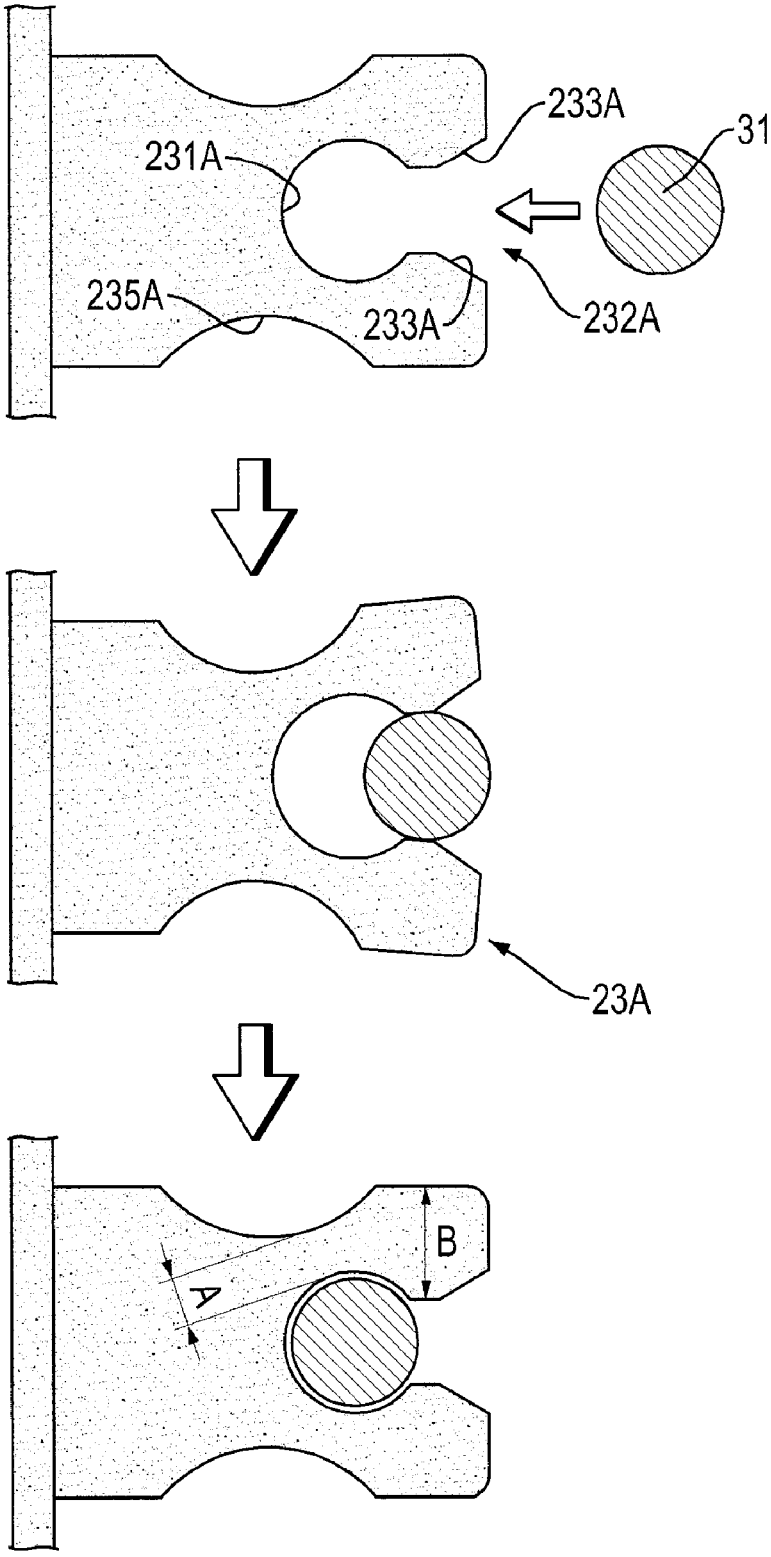
FIG. 10 is operational top views in partial section of the tool hanger assembly in FIG. 9.

With reference to FIGS. 6 to 8, hand tools, such as screwdrivers 30, are respectively put into the tool mounts 23. Each screwdriver 30 has a shank 31. When each shank 31 is put into the tool hole 231 via the mounting slit 232, the shank 31 presses the guiding faces 233 and enlarges the mounting slit 232, the tool hole 231 and the stretching groove 234 to enter the tool hole 231. Consequently, each shank 31 can be received and positioned in the tool hole 231 when the tool hole 231 recovers to an original position. With reference to FIGS. 9 to 10, a second embodiment of the tool hanger assembly is substantially the same as the first embodiment except that each tool mount 23A has two opposite outer surfaces and two concaves 235A. The concaves 235A of each tool mount 23A are respectively and longitudinally formed in the outer surfaces and formed through the top surface and the bottom surface of the tool mount 23A. Similarly, when each shank 31 is put into the tool hole 231A via the mounting slit 232A, the shank 31 presses the guiding faces 233A, enlarges the mounting slit 232A and the tool hole 231A and deforms the concaves 235A to enter the tool hole 231A. Consequently, each shank 31 can be received and positioned in the tool hole 231A when the tool hole 231A recovers to an original position.

Furthermore, a minimum distance A between the concave 235A and the tool hole 231A is smaller than a minimum distance B between the outer surface of the tool mount 23A and the mounting slit 232A except the guiding face 233A to enable enlarged deformation of the mounting slit 232A of the tool mount 23A.

Figure 11:
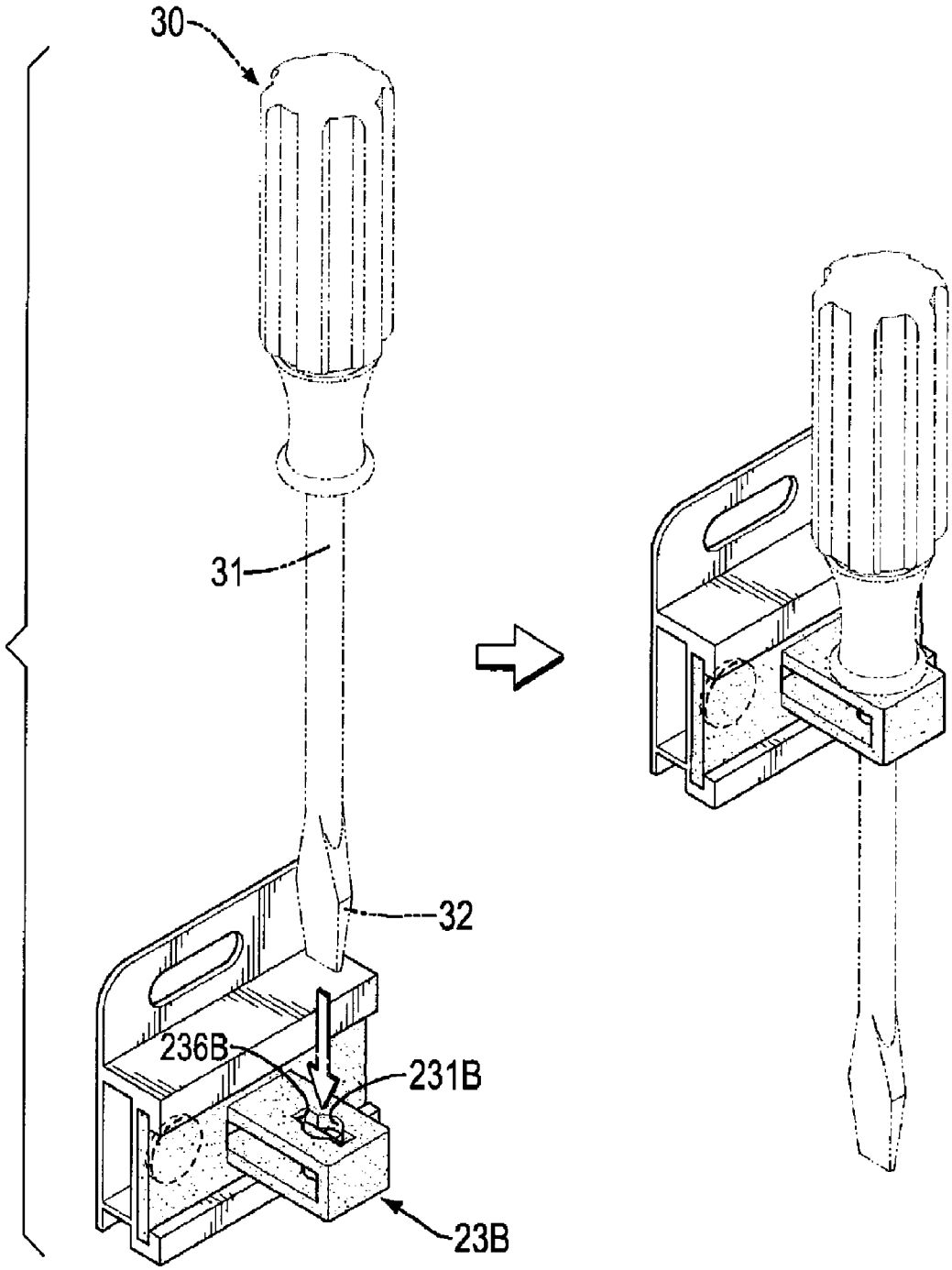
FIG. 11 is operational perspective views of a third embodiment of the tool hanger assembly in accordance with the present invention.

With reference to FIG. 11, a third embodiment of the tool hanger assembly is substantially the same as the first embodiment except that each tool mount 23B does not have the mounting slit 232 and the stretching groove 234. Each tool mount 23B has a slot 236B. Each slot 236B is longitudinally formed through the top surface and the bottom surface of the tool mount 23B and communicates with the tool hole 231B. The tool hole 231B is located at a central segment of the slot 236B. When the screwdrivers 30 are respectively put into the tool holes 231B, tips 32 of the screwdrivers 30 respectively pass through the slots 236B and the shanks 31 are respectively received in the tool holes 231B.

The hanger 20 with the multiple tool mounts 23,23A,23B can hang the multiple screwdrivers 30. Because combining the hanger 20 having the multiple tool mounts 23,23A23B with the frame 10 is easy, to assemble the hanger 20 with the frame 10 is quick, reduces manufacturing cost and is convenient for hanging multiple screwdrivers 30.

What is claimed is:

1. A tool hanger assembly comprising:

a frame having an elongated back plate having a top;

a bottom opposite to the top of the back plate;

two opposite ends;

a side surface; and two mounting holes formed through near the top and respectively near the opposite ends of the back plate; and an elongated bracket mounted securely on the side surface of the frame and having a length the same as that of the side surface of the back plate;

an elongated upper protrusion mounted securely on the side surface near the top of the back plate and located below the mounting holes;

an elongated lower protrusion mounted securely on the side surface near the bottom of the back plate and located below and parallel to the upper protrusion;

a rectangular front plate located between and securely mounted on the upper protrusion and the lower protrusion and having an abutting surface opposite to the back plate;

a recess formed between the upper protrusion, the lower protrusion and the front plate and having a bottom located on the abutting surface of the front plate;

two round button holes formed through the front plate and respectively adjacent to the ends of the back plate;

an upper rib protruding from the upper protrusion toward the lower protrusion; and a lower rib protruding from the lower protrusion toward the upper rib; and a hanger connected securely with the frame and having a base plate shaped as and mounted securely in the recess and having a mounting surface opposite to the abutting surface of the front plate and abutted by the upper rib and the lower rib;

a positioning button formed on the base plate and selectively engaged with one of the button holes; and multiple hollow tool mounts mounted securely on the mounting surface of the base plate at intervals and located between the upper rib and the lower rib, each tool mount having a top surface;

a bottom surface; and a tool hole longitudinally formed through the top surface and the bottom surface of the tool mount.

2. The tool hanger assembly as claimed in claim 1, wherein each tool mount has an operating surface opposite to the base plate;

a mounting slit longitudinally formed in the operating surface, formed through the top surface and the bottom surface of the tool mount, communicating with the tool hole and having two opposite inner surfaces; and two guiding faces respectively formed on the inner surfaces of the mounting slit.

3. The tool hanger assembly as claimed in claim 2, wherein each tool mount has a stretching groove longitudinally formed in the tool mount toward the base plate and communicating with the tool hole.

4. The tool hanger assembly as claimed in claim 2, wherein each tool mount has two opposite outer surfaces; and two concaves respectively and longitudinally formed in the outer surfaces and formed through the top surface and the bottom surface of the tool mount.

5. The tool hanger assembly as claimed in claim 4, wherein a minimum distance between the concave and the tool hole of each tool mount is smaller than a minimum distance between the outer surface of the tool mount and the mounting slit except the guiding face of the tool mount.

6. The tool hanger assembly as claimed in claim 1, wherein each tool mount has a slot longitudinally formed through the top surface and the bottom surface of the tool mount and communicating with the tool hole; and the tool hole is located at a central segment of the slot.

* * * * *